US007641604B2

(12) United States Patent
Blount

(10) Patent No.: US 7,641,604 B2
(45) Date of Patent: Jan. 5, 2010

(54) EXERCISE DEVICE

(76) Inventor: Charles Blount, 9034 Sunset Blvd., Suite 100, West Hollywood, CA (US) 90069

( * ) Notice: Subject to any disclaimer, the term of this patent is extended or adjusted under 35 U.S.C. 154(b) by 8 days.

(21) Appl. No.: 12/013,229

(22) Filed: Jan. 11, 2008

(65) Prior Publication Data

US 2008/0261788 A1 Oct. 23, 2008

Related U.S. Application Data

(60) Provisional application No. 60/912,505, filed on Apr. 18, 2007.

(51) Int. Cl.
*A63B 71/00* (2006.01)

(52) U.S. Cl. ..... 482/139

(58) Field of Classification Search ..... 482/105, 482/139, 23, 79, 81–82, 121–122, 124–126, 482/129, 140; 4/558, 609; 24/716
See application file for complete search history.

(56) References Cited

U.S. PATENT DOCUMENTS 1,876,743 A 9/1932 Pilates
2,132,862 A 10/1938 Pilates
4,480,828 A * 11/1984 Kifferstein ..... 482/74
5,152,731 A 10/1992 Troutman
5,456,138 A 10/1995 Nutile et al.
5,569,137 A * 10/1996 Uen ..... 482/126
7,101,325 B2 9/2006 Rigouby
7,175,574 B2 2/2007 Carmel et al.
7,326,157 B2 * 2/2008 Wu ..... 482/126

* cited by examiner

*Primary Examiner*—Loan H Thanh
*Assistant Examiner*—Shila Abyaneh
(74) *Attorney, Agent, or Firm*—Marc E. Hankin; Kevin E. Schraven; Hankin Patent Law, APL

(57) ABSTRACT

Various embodiments of the invention are directed towards an exercise device for use with Pilates method exercise and other exercise methods. The exercise device is used either the arms or legs of the user for various exercises. The exercise device improves upon related-art system by allowing users to performing exercises while actively engaging the hands or legs of the device with the device in a manner that remains comfortable during exercises.

5 Claims, 5 Drawing Sheets

EXERCISE DEVICE

This application relies for priority on the filing date, Apr. 18, 2007, of a Provisional Patent Application, Ser. No. 60/912,505, entitled "Exercise Device," to inventor Charles Blount, all the contents of which are incorporated herein by this reference.

FIELD OF INVENTION

Various embodiments of this invention relate, generally, to exercise devices; more particularly, to exercise devices that assist with stretching and strengthening the human body.

BACKGROUND

Exercise and physical fitness are an important means of maintaining health, strength, and longevity. To this end, innumerable devices and techniques have been developed for strengthening and stretching the body and muscles. One such popular technique is the Pilates Method, which was developed by Joseph Pilates in the early twentieth century. A number of accompanying devices have been developed for the practice of the Pilates Method. (See, for example, U.S. Pat. Nos. 1,876,743 and 2,132,862 to J. H. Pilates).

In performing many of the stretching and strengthening exercises in the Pilates Method and other exercise methods, other exercise devices are commonly employed. U.S. Pat. No. 7,101,325 to Rigouby, for example, discloses an exercise device that is configured to allow the user to stretch a plurality of extensible strands. In this manner, the device allows users to perform stretching and strengthening exercises. The device, however, fails to disclose a system for actively engaging the device to the hands or feet of the user.

Another such device is disclosed by U.S. Pat. No. 7,175,574 to Carmel et al. Carmel's device discloses an exercise device, which comprises a resistance tube and a body engaging member that engages a portion of the user's body, such as the user's feet. The device further features handles at the opposite ends of the resistance tube, which may be engaged and pulled by the user. In this manner, Carmel's device allows users to exercise and stretch the body by engaging device and applying force against the resistance supplied by the resistance tube. Carmel's device, however, fails to teach a system for actively engaging the exercise device with the user's hands or feet.

Another device, which is commonly used in Pilates and other exercise methods, is commonly known as a Pilates-bar or exercise-bar. The Pilates-bar or exercise-bar generally comprises a dowel-shaped bar, which engages the hands or feet of the user during exercise. The bar is, also, attached to a resistance device, in order that the user may apply force to body movements, which are engaged to the bar.

These typical bars, however, suffer from certain shortcomings in the manner in which they engage with the user's body parts. The typical manner used in the art is illustrated by Carmel's device, which consists of a hand/foot grip that passively engages with the hand or foot of the user. This system is undesirable because, during exercise activities when resistance is placed on the bar, the grip can become loose and, possibly, released from the user's hand or foot.

Other, non-Pilates exercise equipment, such as a bicycle or a stationary bicycle, have mechanisms to actively engage the users feet. U.S. Pat. No. 7,175,574 to Nutile et al., for example, discloses a retractable foot retaining clip for the pedal of a bicycle. This spring driven device allows the bicycle rider to have his feet actively engaged with the pedals of the bicycle. Nutile's device, although appropriate for a large and cumbersome bicycle, would be inappropriate for incorporation into a typical Pilates bar. Nutile's device acts like a clamp and puts firm pressure on foot of the bicycle rider. The users of a Pilates bar are generally not wearing thick protective bicycle riding shoes to shield their feet against the vice-like clamp of Nutile's device. Thus, Nutile's device would be very uncomfortable on the feet of a Pilate's bar user. Similarly, Nutile's device would be completely inappropriate for actively engaging the hands of a Pilate's bar user. Additionally, Nutile's device is a clamp designed to work with the wide and flat surface of a pedal. The Pilate's bar is not flat and is not as wide as a pedal. Thus, Nutile's device does not help the user of a Pilate's bar to actively engage a user's hands or feet.

Therefore, there remains a long felt need in the art for an exercise device, which allows users to engage with the device and is configured such that the device actively engages with the hand or the foot of the user, such that it cannot become dislodged during exercise activities.

SUMMARY OF THE INVENTION

Various embodiments of the invention are directed towards overcoming the above shortcomings by disclosing an exercise device that is configured to actively engage the hands or feet of the user as the user exercises with the device. The device represents a marked improvement on the above devices because, as force is placed the user's hands or feet, the force is transmitted to a strap that engages the device with the hands or feet of the user.

Various embodiments of the device comprise, generally speaking, a dowel shaped bar and two straps that are configured to engage with the hands or feet of the user. The dowel shaped bar comprises a firm, straight, dowel-shaped bar made from any of the materials for exercise bars, such as wood, plastics, metals, and other such materials known in the art.

The straps are attached to the bar and configured such that, when pressure is placed on the bar from a resistance mechanism, the straps are tightened in order to actively engage the hands or feet of the user. In this manner, the device improves on prior art devices, which do not actively engage with the hands or feet of the user.

In various embodiments of the invention, the straps further feature padded sections, in order to soften the pressure from the straps on the hands and feet of the user.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. Also, the reference or non-reference to a particular embodiment of the invention shall not be interpreted to limit the scope the invention.

In the following description, certain terminology is used to describe certain features of one or more embodiments of the invention. For instance, "Pilates" refers to any of the various exercise systems known in the art, including but not limited to the Pilates method and other methods for strengthening and stretching the body; "dowel" refers to generally tubular shaped objects of circular, hexagonal, octagonal, decagonal, or other such shapes; "strap" refers to any of the various vinyl, plastic; leather, polyester, or similar such attachment devices and materials known in the art.

Figure 1:
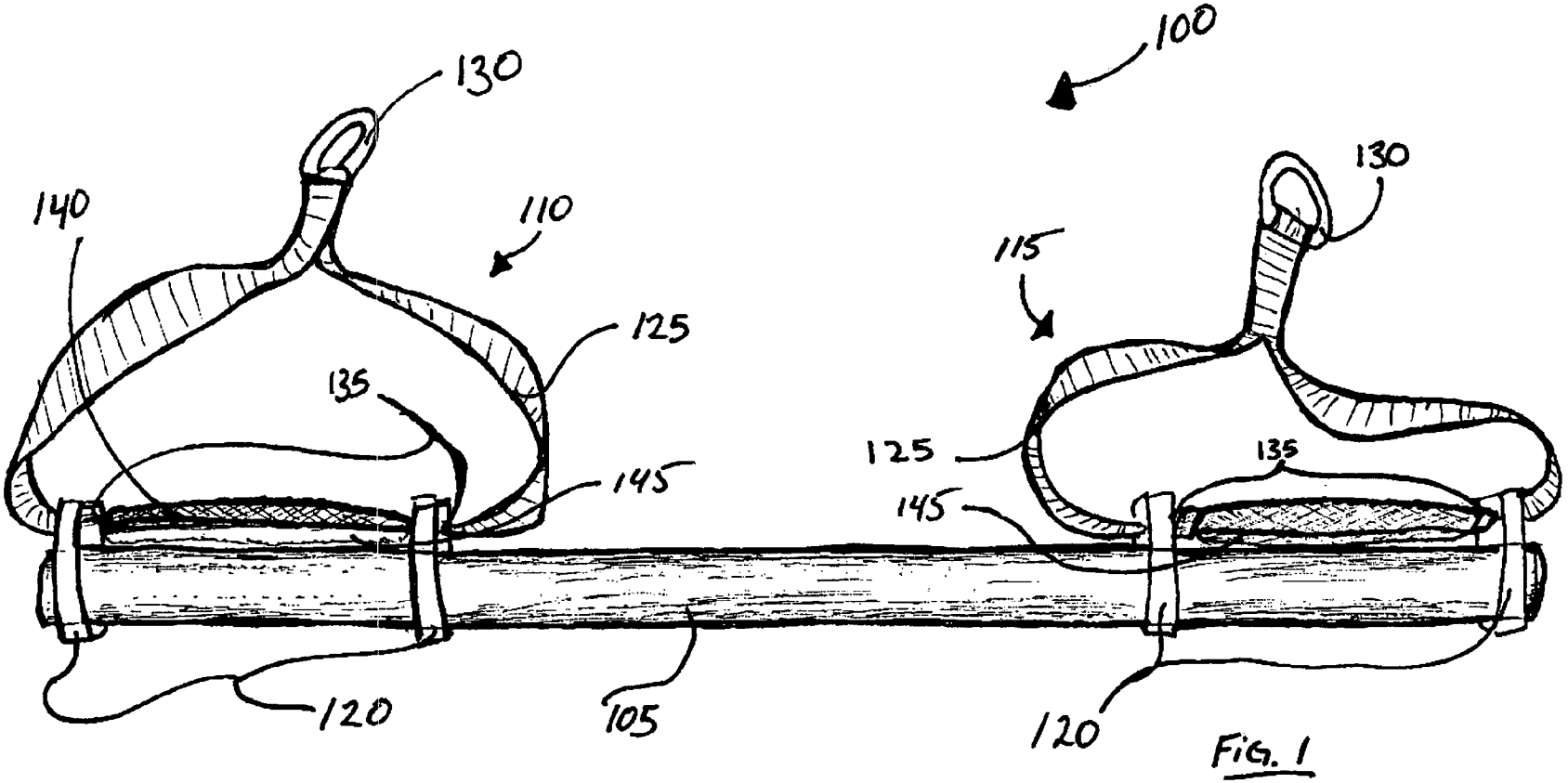
FIG. 1 is an illustration from a perspective view of one embodiment of the invention.

FIG. 1 is an illustration from a perspective view of one embodiment of the invention. The exercise device 100 in one embodiment of the invention is illustrated along with its constituent parts. The exercise device 100 features a dowel-shaped rod 105, which serves to attach the various components of the exercise device, including the left limb attachment straps 110 and the right limb attachment straps 115. Each of the limb attachment straps features a series of components, which allow the user to engage with the dowel-shaped rod 105, including the two rod clasps 120, the strap 125, the O-hook 130, the opening 135, and the limb pad 145. The various components are use used in order to allow the user to perform Pilates method and other exercise methods. The strap 125 is attached to dowel-shaped rod 105 by passing it though the opening 135 of the two rod clasps 120. The limb pad 145 is attached to the strap 125 between the two rod clasps 120. A user engages the exercise device 100 by inserting both arms or both legs beneath the limb pads 145 and against the dowel-shaped rod 105. The O-hooks 130, meanwhile, are attached to an elastic extension device or weight device. In this manner, as the limbs press against the dowel-shaped rod 105 the O-hooks 130 are pulled away from the two rod clasps 120 and the strap 125 is pulled taut. Thus, the user's arms or legs are firmly engaged with the exercise device 100. The limb pads 145 are comprised of a padded material, in order to increase comfort to the user as the strap 125 is taut.

Figure 2:
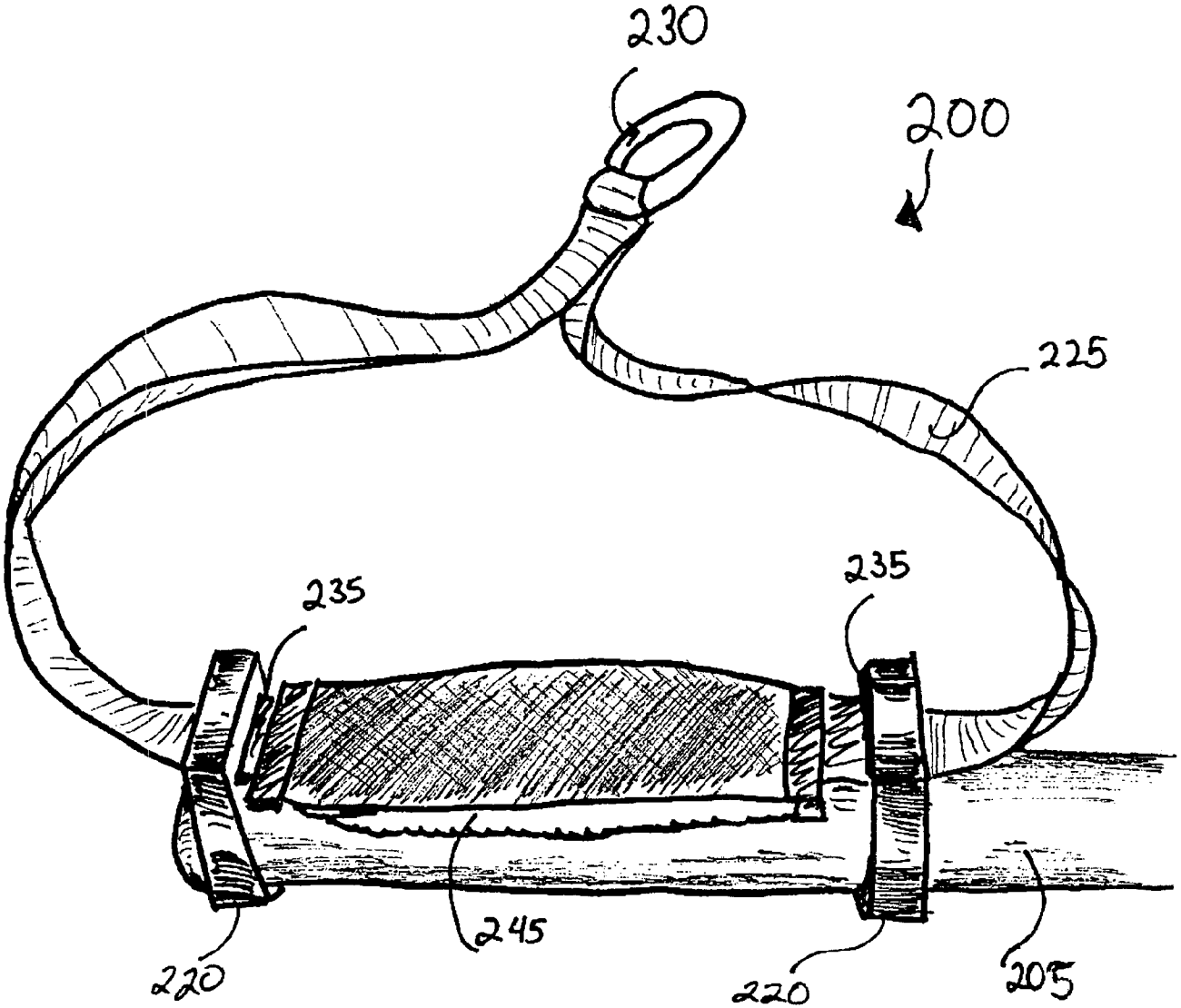
FIG. 2 is a detailed illustration from a perspective view of one embodiment of the invention.

FIG. 2 is a detailed illustration from a perspective view of one embodiment of the invention. FIG. 2 illustrates in detail the limb attachment straps in various embodiments of the invention. Each of the limb attachment straps features a series of components, which allow the user to engage with the dowel-shaped rod 205, including the two rod clasps 220, the strap 225, the O-hook 230, the opening 235, and the limb pad 245. The various components are use used in order to allow the user to perform Pilates method and other exercise methods. The strap 225 is attached to dowel-shaped rod 205 by passing it though the opening 235 of the two rod clasps 220. The limb pad 245 is attached to the strap 225 between the two rod clasps 220. A user engages the exercise device 200 by inserting both arms or both legs beneath the limb pads 245 and against the dowel-shaped rod 205. The O-hooks 230, meanwhile, are attached to an elastic extension device or weight device. In this manner, as the limbs press against the dowel-shaped rod 205 the O-hooks 230 are pulled away from the two rod clasps 220 and the strap 225 is pulled taut. Thus, the user's arms or legs are firmly engaged with the exercise device 200. The limb pads 245 are comprised of a padded material, in order to increase comfort to the user as the strap 225 is taut.

Figure 3:
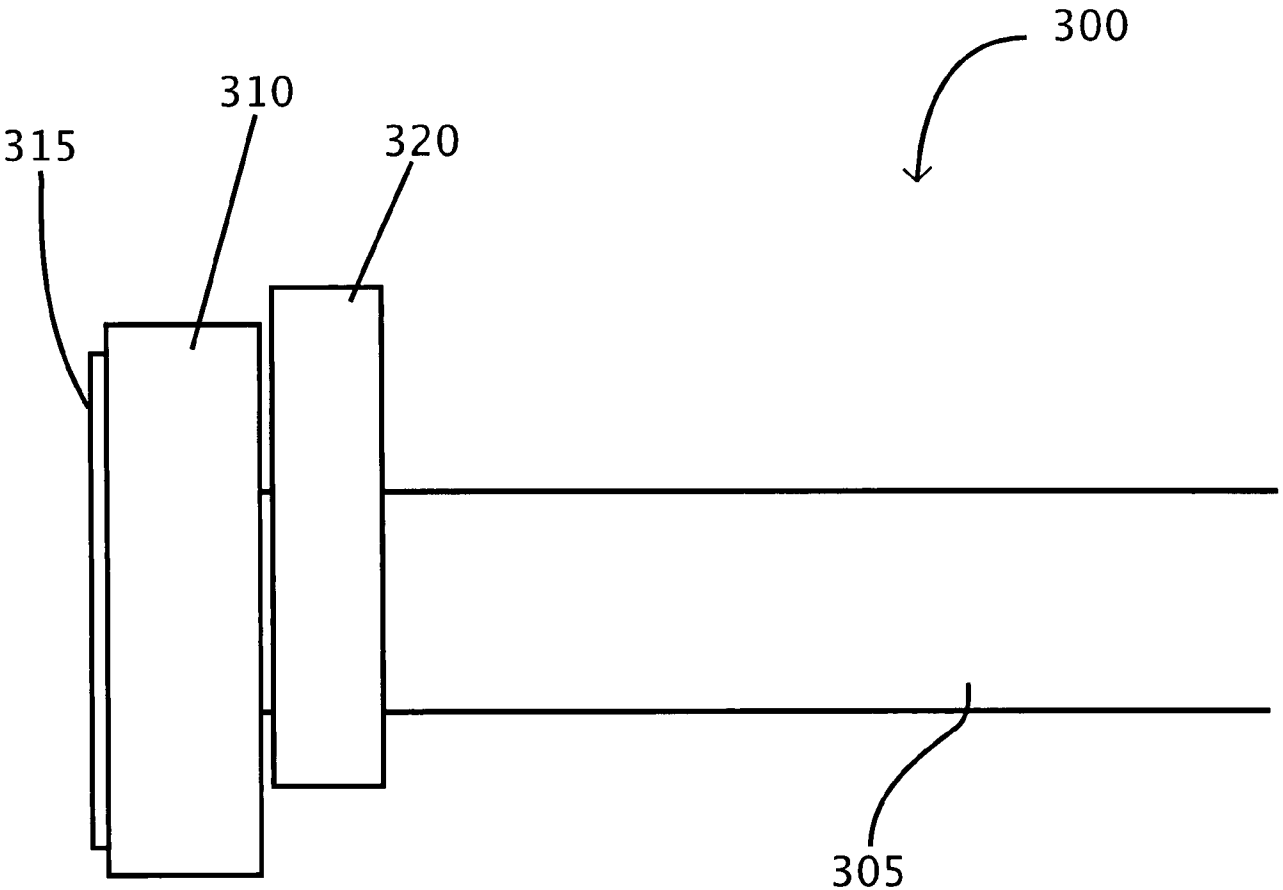
FIG. 3 is a detailed illustration from a side view of one embodiment of the invention.

FIG. 3 is a detailed illustration from a side view of one embodiment of the invention. The exercise device 300 features a dowel-shaped rod 305 with a bumper 310 and cap 315 outside of the two rod clasps 320. The bumper provides protection to the other components of exercise device 300 and protection to the user. The cap 315 provides support and protection to the bumper 310.

Figure 4:
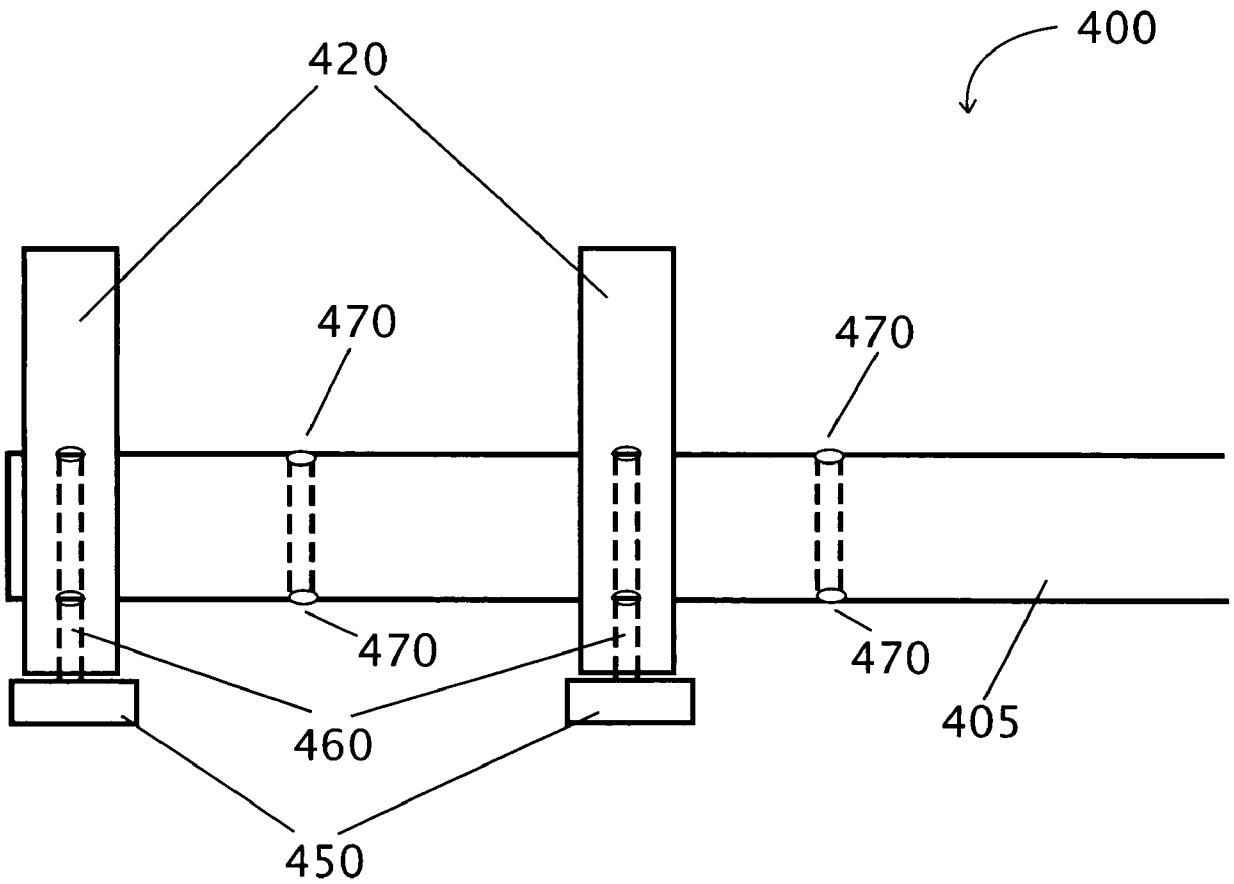
FIG. 4 is a detailed illustration from a side view of one embodiment of the invention.

FIG. 4 is a detailed illustration from a side view of one embodiment of the invention. The exercise device 400 features a dowel-shaped rod 405 with rod clasps 420 that are axially adjustable. The pin head 450 allows the user to insert or remove the affixing pin 460 from one or two rod clasps 420. When the pin 460 is removed, the user can axially adjust the rod clasps 420. In this embodiment, the user can adjust the two rod clasps to unused pin openings 470. Once axially adjusted, the user inserts the affixing pin 460 back into the rod clasps 420 and the rod clasp is re-engaged with the dowel-shaped rod 405. This allows the user of exercise device 400 to firmly engage a variety of limb sizes.

Figure 5:
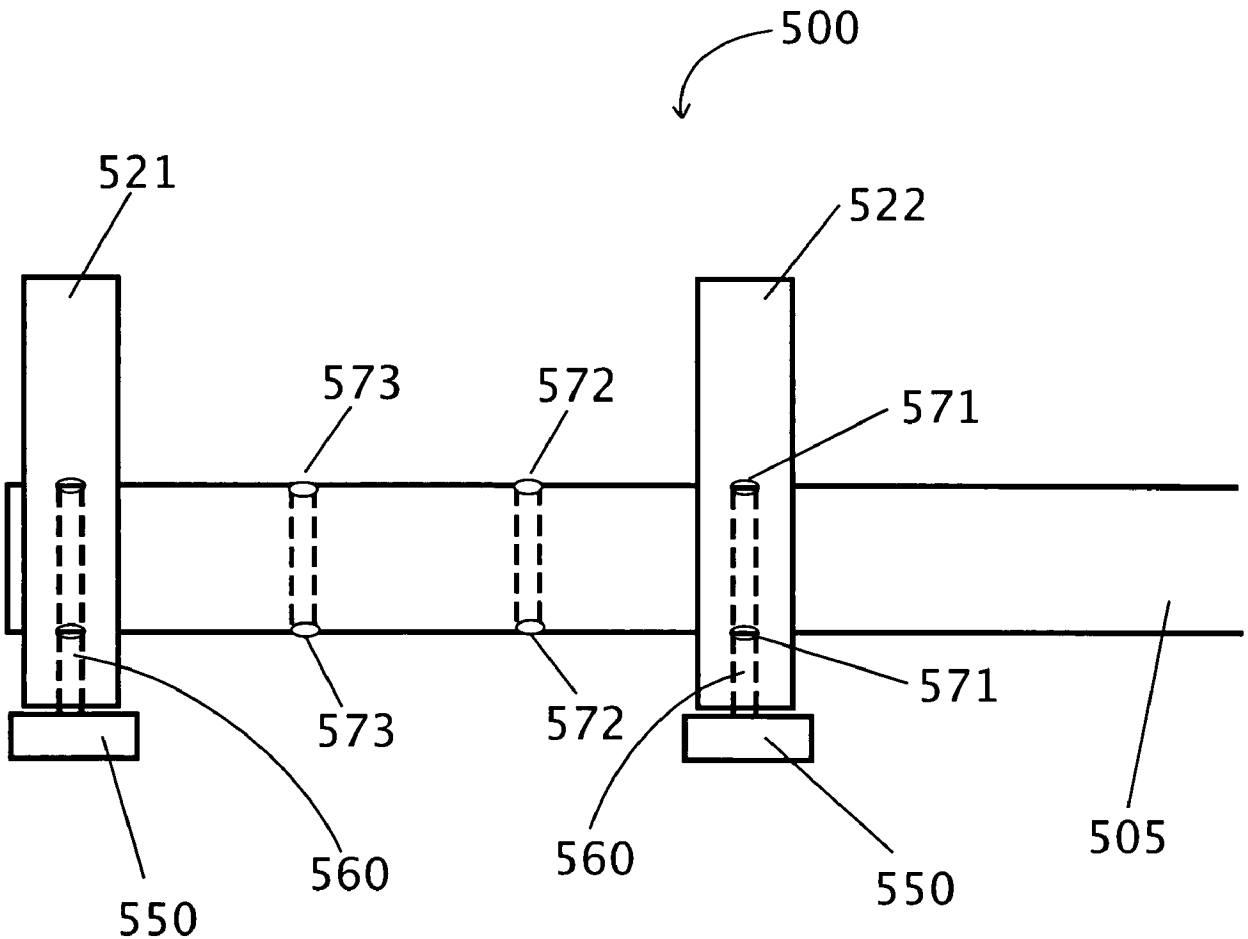
FIG. 5 is an illustration from a side view of one embodiment of the invention and details axial adjustment.

FIG. 5 is a detailed illustration from a side view of one embodiment of the invention. The exercise device 500 features a dowel-shaped rod 505 with distal rod clasp 521 and proximal rod clasp 522. This illustration details the axial adjustment of the proximal rod clasp 522. This adjustment gives the user more space between distal rod clasp 521 and proximal rod clasp 522, thus allowing a larger limb to actively engage the exercise device 500. The pin head 550 allows the user to insert or remove the affixing pin 560 from proximal rod clasp 522. In this embodiment, proximal rod clasp 522 is engaged with pin opening 571. Pin opening 572, which previously in FIG. 4 was engaged with proximal rod clasp 522 is now unused. Pin opening 573, meanwhile, remains unused.

What is claimed is:

1. An exercise device, comprising:

a rod, wherein said rod is dowel-shaped, said rod has a length generally equal to the span of a human adult's shoulders, and said rod has a left end and a right end;

a flexible left strap; wherein said flexible left strap has two ends;

a flexible right strap; wherein said flexible right strap has two ends;

two left connectors, wherein said two left connectors comprising of a proximal left connector and a distal left connector;

two right connectors, wherein said two right connectors comprising a proximal right connector and a distal right connector;

wherein each of said right connectors further comprises an opening, and each of said left connectors further comprises an opening;

wherein said left connectors are attached to said left end of said rod and wherein said proximal left connector opening and said distal left connector opening are adjacent to said rod and aligned on a same side of said rod;

wherein said right connectors are attached to said right end of said rod and wherein said proximal right connector opening and said distal right connector opening are adjacent to said rod and aligned on a same side of said rod;

wherein said flexible left strap passes though said proximal left connector opening and though said distal left connector opening, wherein said flexible left strap lays parallel to said rod between said two left connectors, and wherein said two ends of said flexible left strap are joined to each other to form a left loop;

wherein said flexible right strap passes through said proximal right connector opening and through said distal right connector opening, wherein said flexible right strap lays parallel to said rod between said two right connectors; and wherein said two ends of said flexible right strap are joined to each other to form a right loop;

wherein said left loop further comprises a left loop ring and said right loop further comprises a right loop ring;

wherein a force applied to said left loop in a direction away from a side of said rod with said distal left connector opening and with said proximal left connector opening causes said flexible left strap between said two left connectors to tighten and apply pressure in a direction towards said rod;

wherein a force applied to said right loop in a direction away from a side of said rod with said distal right connector opening and with said proximal right connector opening causes said flexible right strap between said two right connectors to tighten and apply pressure in said direction towards said rod; and wherein said pressure in said direction towards said rod aids in preventing a plurality of limbs of a user from disengaging with said rod.

2. The exercise device of claim 1, further comprising:

a right pad; and a left pad;

wherein said right pad is attached to said flexible right strap between said two right connectors and oppose said rod;

wherein said left pad is attached to said flexible left strap between said two left connectors and oppose said rod;

wherein said right pad allows said flexible right strap to apply additional pressure in said direction towards said rod; and wherein said left pad allows said flexible left strap to apply additional pressure in said direction towards said rod.

3. The exercise device of claim 2, wherein said two left connectors are adjustable along a length of said rod and wherein said two right connectors are adjustable along said length of said rod.

4. The exercise device of claim 3, wherein said distal right connector is fixedly attached to said right end of said rod and said distal left connector is fixedly attached to said left end of said rod; and wherein said proximal right connector and said proximal left connector are adjustable along said length of said rod to allow a variety of said plurality of limbs of said user to engage with said rod.

5. The exercise device of claim 4, further comprising:

a left bumper; wherein said left bumper is attached to said left end of said rod;

a right bumper; wherein said right bumper is attached to said right end of said rod;

a left cap; wherein said left cap is attached to said left end of said rod;

a right cap; wherein said right cap is attached to said right end of said rod;

wherein said left cap is attached distally to said left bumper; said right cap is attached distally to said right bumper, said left bumper is attached distally to said distal left connector, and said right bumper is attached distally to said distal right connector.

* * * * *